US006691798B1

(12) United States Patent
Lindsay

(10) Patent No.: US 6,691,798 B1
(45) Date of Patent: Feb. 17, 2004

(54) VARIABLE HAND PRESSURE ACTIVATED POWER TOOL

(76) Inventor: Steven James Lindsay, 3714 W. Cedar Hills Dr., Kearney, NE (US) 68845

( * ) Notice: Subject to any disclaimer, the term of this patent is extended or adjusted under 35 U.S.C. 154(b) by 0 days.

(21) Appl. No.: 10/267,630

(22) Filed: Oct. 9, 2002

Related U.S. Application Data

(60) Provisional application No. 60/390,426, filed on Jun. 19, 2002.

(51) Int. Cl.[7] ..... B25D 9/14

(52) U.S. Cl. ..... 173/115; 173/128; 173/200; 173/206; 173/207; 137/505.12; 137/505.14

(58) Field of Search ..... 173/115, 206, 173/122, 207, 132, 200, 128; 137/505.12, 505.14

(56) References Cited

U.S. PATENT DOCUMENTS

| | | | | | |
|---|---|---|---|---|---|
| 3,393,755 | A | | 7/1968 | Glaser et al. | |
| 3,904,305 | A | * | 9/1975 | Boyd | 415/25 |
| 4,030,556 | A | | 6/1977 | Phillips | |
| 4,287,906 | A | * | 9/1981 | Green et al. | 137/118.02 |
| 4,353,426 | A | * | 10/1982 | Ward | 173/202 |
| 4,694,912 | A | | 9/1987 | Glaser | |
| 4,790,414 | A | * | 12/1988 | Harrison | 188/152 |
| 4,903,784 | A | | 2/1990 | Glaser | |
| 5,203,417 | A | | 4/1993 | Glaser | |
| 5,332,194 | A | | 7/1994 | Austin, Jr. et al. | |
| 5,407,017 | A | * | 4/1995 | Wehr et al. | 173/54 |
| 5,449,044 | A | | 9/1995 | Phillips | |
| 5,515,930 | A | | 5/1996 | Glaser | |
| 5,769,172 | A | * | 6/1998 | Sher | 173/97 |
| 5,803,183 | A | | 9/1998 | Phillips | |
| 5,930,899 | A | | 8/1999 | Hartman et al. | |
| 6,076,549 | A | * | 6/2000 | Bahat et al. | 137/505.14 |
| 6,085,850 | A | | 7/2000 | Phillips | |
| 6,095,256 | A | | 8/2000 | Lindsay | |
| 6,230,607 | B1 | | 5/2001 | Rehrl et al. | |
| 6,401,836 | B1 | | 6/2002 | Heinrichs et al. | |
| 6,460,629 | B2 | * | 10/2002 | Bookshar et al. | 173/176 |

* cited by examiner

*Primary Examiner*—Rinaldi I. Rada
*Assistant Examiner*—Brian Nash

(57) ABSTRACT

A hand-held power tool for use in hand working operations including a hand pressure sensing element for adjusting the power of the tool. More specifically, the invention provides a hand engraving power tool that is activated from absence of power to much greater power or anywhere in between determined by the amount of pressure exerted by a human hand on the tool's handle.

13 Claims, 6 Drawing Sheets

VARIABLE HAND PRESSURE ACTIVATED POWER TOOL

This application claims benefit of provisional application No. 60/390,426 filed on Jun. 19, 2002.

BACKGROUND OF THE INVENTION

1. Field of Invention

The present invention relates to impact power tools and, more particularly, to hand-held, variable, hand pressure activated power tools that are used for delicate hand engraving and stone setting operations in the hand engraving and jewelry fields. In addition, dental and surgical fields that use pneumatic and ultrasonic scales used in the , as well as impact scribes for paleontology fossil recovery fields will benefit from the present invention.

2. Description of Prior Art

A hand-held impact power tool is known from U.S. Pat. No. 6,095,256 in the name of Steven Lindsay, which may be used for engraving, carving, and delicate stone setting operations. Although this known impact power graver provides improved control of delicate hand-working operations, it would be desirable to provide an impact power graver with a feature that will provide greater ease of use. The prior applications Ser. Nos. 09/754,889 and 09/876,434 in the name of Steven Lindsay filed on dates Jan. 5, 2001 and Jun. 7, 2001 respectively, U.S. Pat. No. 6,095,256 to Lindsay as well as U.S. Pat. Nos. 6,085,850, 5,803,183, 5,449,044, and 4,030,556, all to Phillips, as well as U.S. Pat. Nos. 5,515,930, 4,694,912 and 5,203,417 to Glaser, and U.S. Pat. No. 3,393,755 to Glaser et al. all employ the use of a foot pedal to control and operate a throttle for a hand held impact tool. The traditional hand engraving tool which has been in existence for centuries, consists of a tool bit (also known as a tool point or graver point) inset into a small round handle that is made to fit into the palm of the human hand. Because prior power assisted gravers mentioned use a foot control they are not natural for the traditional hand engraver who has learned palm push hand engraving. These highly skilled people as well as people beginning to learn to hand engrave have to learn to coordinate the foot throttle and hand motion when making an engraving cut with prior power gravers. With these prior power gravers it is important to only depress the foot control while holding the graver point in the cut. If the pedal is depressed when not held snuggly in the cut, there is a high possibility that the point of the graver will break and the cut will have chatter marks and burs. There is a need for a hand power engraving tool that is activated by the pressure of the person's palm pushing the tool instead of using a foot control to activate the device. A palm push, variable power graver will prevent the tool being operated when not held in a cut and thus help those learning to engrave produce cleaner engraving cuts. The pressure activated power graver would need to be able to deliver very subtle, light impacts when the user is palm pushing lightly and it would need to deliver harder impacting power when greater force is exerted by the palm of the hand. The pressure would therefore need to activate the tool from an absence of power to much greater power and anywhere in between simply by the amount of pressure the user is creating with his or her palm on the tools handle. This type of device would also need to be user adjustable for the amount of force exerted by the person using it. One person may desire the tool to activate throughout a power range with very minimal palm pressure while another person may desire a harder variable palm pressure.

OBJECTS AND SUMMARY OF THE INVENTION

It is the object of this invention to provide a palm push hand engraving power tool that is activated from an absence of power to much greater power or anywhere in between simply by the amount of pressure exerted by the palm of hand on the tool's handle. It is also an object of this invention to provide a hand engraving power tool that is natural for the user to operate. It is also an object that the invention can be utilized in a wider scope or field of use than merely the hand engraving and jewelry fields. Dental power scalers, including ultrasonic engravers and scalers, power surgical knives, impact scribes for paleontology fossil recovery and even larger hand held impact hammers used by artist for sculpturing and carving stone and marble may benefit from their tools being activated and adjustable in power by the pressure exerted on the tool with the hand.

BRIEF DESCRIPTION OF THE DRAWINGS

Embodiments of the present invention are described below with reference to attached drawing figures, wherein.

DETAILED DESCRIPTION

Figure 1:
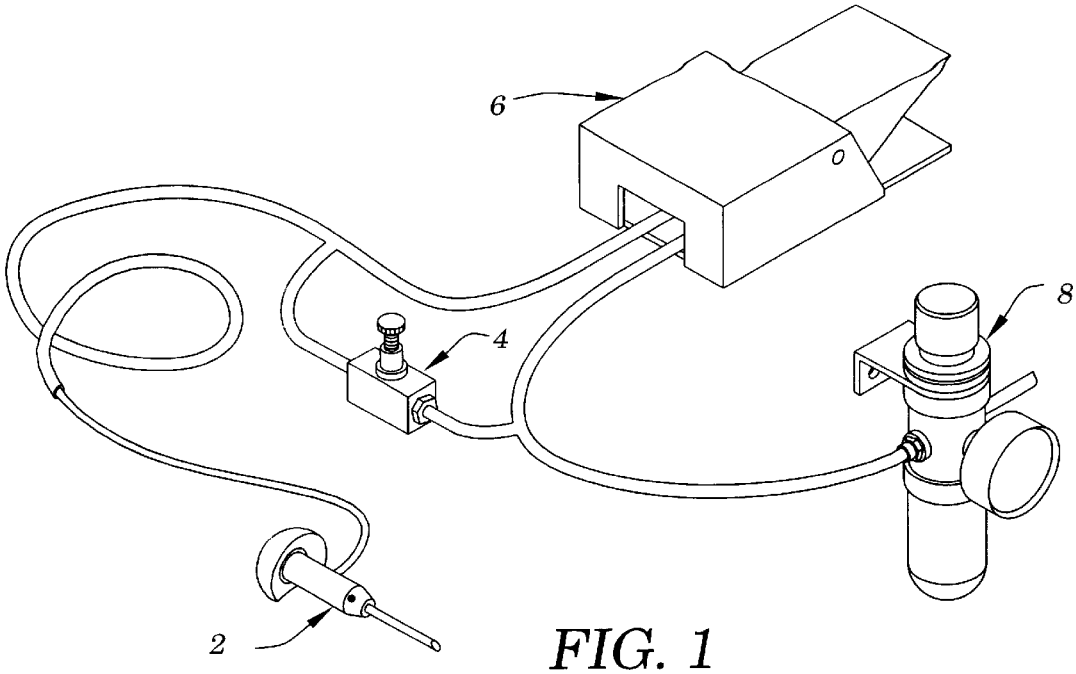
FIG. 1 PRIOR ART
FIG. 1 is a PRIOR ART perspective view of the hand-held pneumatic impact tool apparatus from prior art patent U.S. Pat. No. 6,095,256, to Lindsay.
Figure 2:
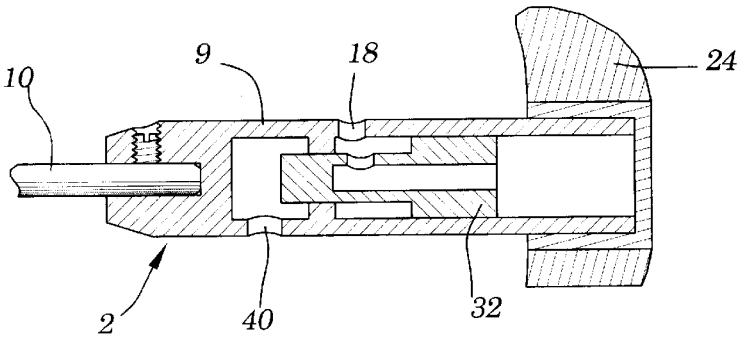
FIG. 2 PRIOR ART
FIG. 2 is a PRIOR ART sectional view of a hand-held pneumatic impact tool from the prior art patent U.S. Pat. No. 6,095,256, to Lindsay.

FIG. 1 and FIG. 2 illustrate Prior Art from my earlier U.S. Pat. No. 6,095,256, to Lindsay. Referring to FIG. 1 this prior art consists of a supply of compressed air (not shown) in communication to an air regulator 8, a foot control 6, a needle valve 4 and an impact handpiece 2. FIG. 2 illustrates the Prior Art impact handpiece 2, which consists of a body 9, a tool tip 10, an inlet port 18, a handle 24, a piston 32, and an outlet exhaust port 40. Rather than covering the complete details of how the prior art device illustrated in FIG. 1 and FIG. 2 operates, please refer to the specifications of the device in U.S. Pat. No. 6,095,256, to Lindsay. Briefly, the Prior Art illustrated in FIG. 1 and FIG. 2 utilizes a foot control 6 to meter a flow of air to handpiece 2. Needle valve 4 is used to bleed a small amount of air flow from the regulated air supply directly to the handpiece 2. This small amount of air flow will keep piston 32 oscillating very finely so that the tool can be in a ready idling state. The idle state is when the piston 32 is oscillating but not impacting into the anvil, while the foot control is not depressed. The idling state of the device is the key feature which allows the prior art device to be used for very fine engraving. Because the tool is already oscillating very finely without impacting before it is brought to the work, the user does not get a sudden burst of impacts when the foot control is depressed slowly, contrary to the engraving power tools developed before it. Instead, as the pedal is depressed the piston 32 will increase in length of strokes until finally it begins impacting against the anvil. As the user continues to depress the foot control the impacts will become more deliberate with harder and harder impacts.

Figure 3:
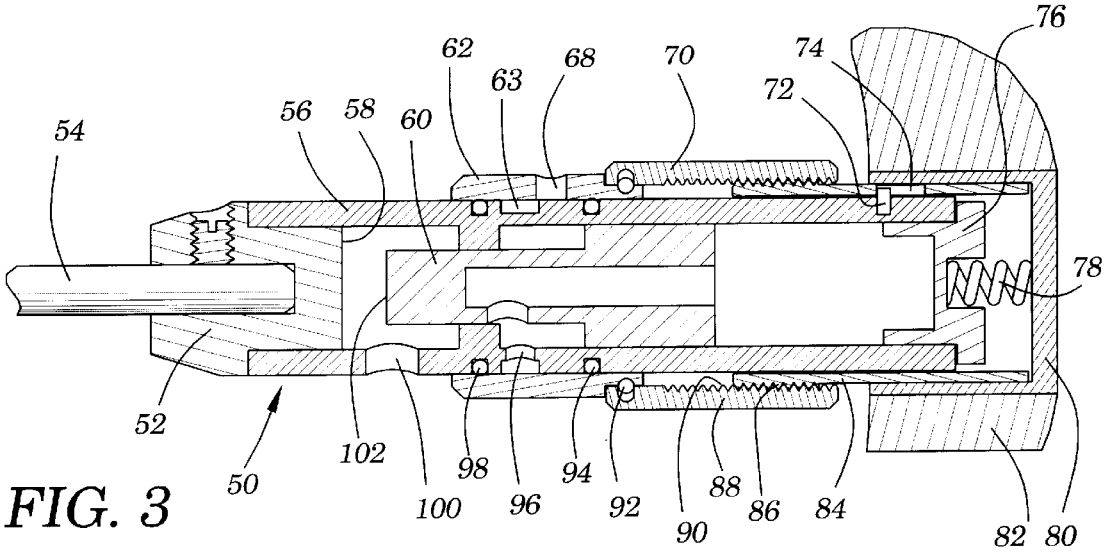
FIG. 3 is a sectional view of a first embodiment of a hand-held pneumatic impact tool constructed in accordance with the present invention.
Figure 4:
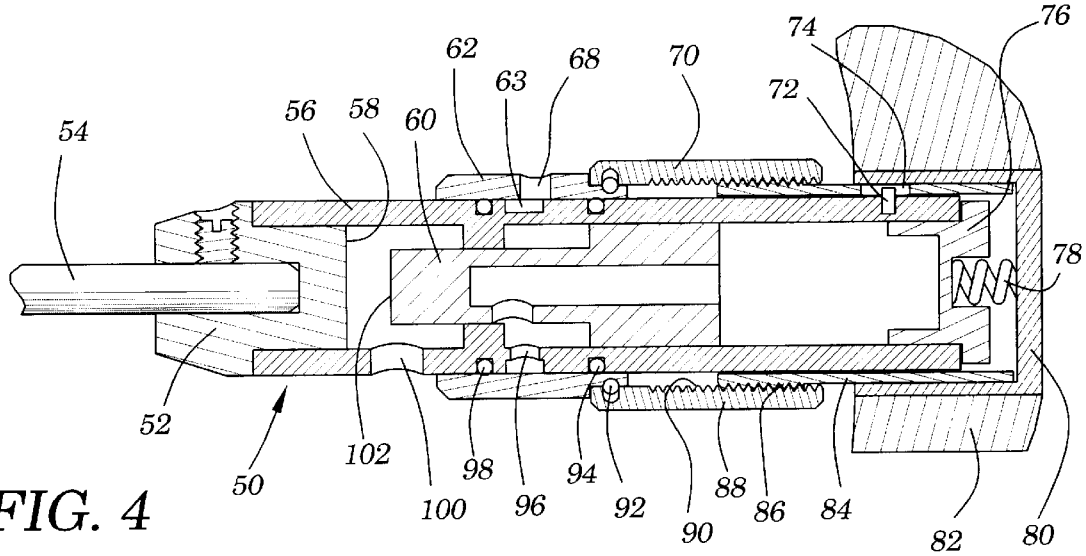
FIG. 4 is the same view as FIG. 3, differing in that the device is depicted as it would be when the handle of the tool is being pushed by the palm of a human hand.

Detailed Description (First Embodiment FIG. 3, FIG. 4)

FIG. 3 and FIG. 4 illustrate a hand-held pneumatic impact tool constructed in accordance with the present invention. Referring to FIG. 3 the hand-held pneumatic impact handpiece 50 in accordance with the present invention includes an anvil 52 provided with a recess for holding a tool tip 54, a body 56 with an outside diameter and an inside diameter, a piston 60, a swivel ring 62 containing an intake hole 68, an idle adjust ring 70 with female threads 90 that are made to mate with male threads 86 on a sliding sleeve 84, sliding sleeve 84 also includes a slot 74 that is slightly wider than pin 72 and that runs lengthwise along the longitudinal axis of sliding sleeve 84 a distance. The handpiece 50 also includes a handle 82 permanently attached to handle end cap 80, a bore end plug 76 that is made to fit with an airtight seal to the end of the bore of the body 56, bore end plug 76 includes a recess to provide a pocket for spring 78. O-ring 92 is made from a resilient material like rubber and is used at-the location depicted within groves in swivel ring 62 and idle adjust ring 70 to fasten these two parts together. O-ring 92 will allow swivel ring 62 to swivel within the idle adjust ring 70 but not allow them to be pulled apart. O-ring 92 could instead be a metal snap ring to achieve the same objective. O-rings 94 and 98 are used between the inside diameter of swivel ring 62 and the outside diameter of body 56 to provide an airtight seal between these two parts. Body 56 also includes an annular grove 63 around the outside diameter, an inlet port 96 and an outlet port 100.

Operation (First Embodiment FIG. 3, FIG. 4)

Figure 11:
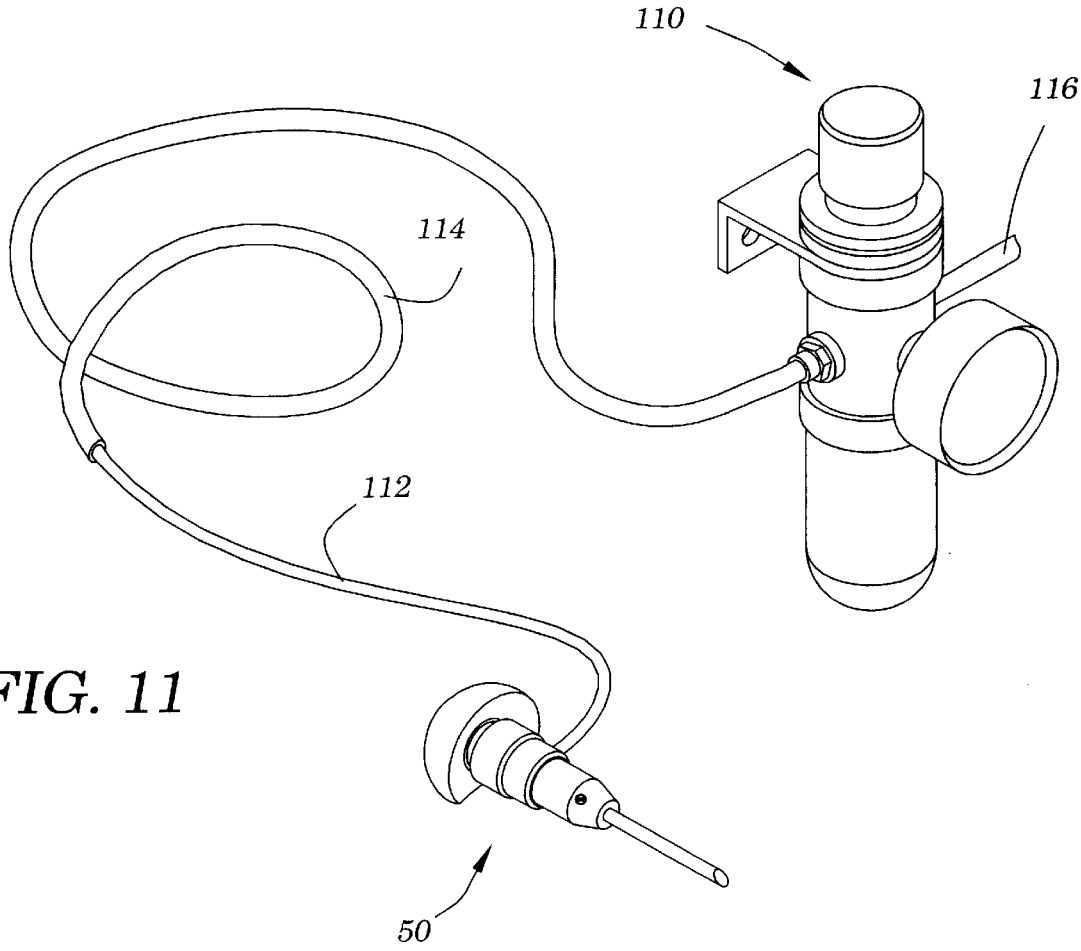
FIG. 11 is a perspective view of a hand-held pneumatic impact tool apparatus in accordance with the present invention.

Referring to FIG. 11, a supply of pressurized air (not shown) is in communication with pressure regulator 110 via tubing 116. The regulated air on the outlet side of pressure regulator 110 is in communication to handpiece 50 via tubing 114 and reduced diameter tubing 112. Referring to FIG. 11, the reduced diameter tubing 112 is connected and in communication with intake hole 68 illustrated in FIG. 3. Referring to FIG. 3, the alignment of intake hole 68 to annular grove 63 will determine the metered amount of air flow and pressures delivered through inlet port 96. Air flow and pressure flowing through inlet port 96 and into body 56 will oscillate piston 60 as described in earlier U.S. Pat. No. 6,095,256, to Lindsay. The idle adjust ring 70 is turned by the operator causing idle adjust ring to move along threads 86. This will in turn move swivel ring 62 and thus adjust how much intake hole 68 and annular grove 63 are in alignment and communication. The idle adjust ring 70 therefore is used to permit a very slight amount of air flow to enter through inlet port 96 when the handpiece is at rest or, when the handle is not being pushed on by the user. The small amount of flow causes the piston 60 to idle, that is, it causes the piston to oscillate only very slightly without piston face 102 impacting against anvil face 58. The idle state is described in earlier U.S. Pat. No. 6,095,256, to Lindsay and used a needle valve 4 (FIG. 1 Prior Art) to adjust this fine flow of air. Referring to FIG. 3 and now with the piston in its idling state, the user holds the tool in his hand so that the handle 82 fits into the palm of the hand. The tool tip 54 is placed on the surface to be engraved and the user begins to apply a slightly amount of pressure against handle 82 as if pushing the tool tip 54 into the work. Spring 78 will begin to depress and body 56 will begin to slip through swivel ring 62, idle adjust ring 70 and sliding sleeve 84 pushing body 56 deeper into handle end cap 80. This will cause intake hole 68 and annular grove 63 to be more in communication, allowing greater air flow and pressure to reach the oscillating piston 60 through inlet port 96. With the increased air flow, the piston will begin to increase in stroke length until there is sufficient flow to cause piston face 102 to begin impacting against anvil face 58. FIG. 4 illustrates the components of handpiece 50 as they appear when the handle of the tool is being pushed by the palm of a human hand. As the user continues to press harder, more air flow is permitted to oscillate the piston with greater velocity which generates harder impacts. When the user removes hand pressure, spring 78 will return the components to their original position and the handpiece will be returned to its idling ready state. Therefore the pressure exerted by the human hand on the handle will determine the metered amount of air delivered to the oscillating piston.

Pin 72 is fixed and press fit into body 56 to act as one. Sliding sleeve 84 includes a slot 74 to permit body 56 to slide in and out, but prevents body 56 spinning. One end of slot 74 provides a stop for pin 72 to prevent spring 78 from pushing the entire assembly out of end cap 80. End cap 80 and sliding sleeve 84 are fastened rigidly together to act as one during operation. Swivel ring 62 is permitted to swivel so the tubing attached to intake hole 68 may be rotated 360 degrees around body 56 by the user for personal preference and comfort. The swivel ring 62 also allows idle adjust ring 70 to be adjusted without also turning the swivel ring 62 and therefore the tubing attachment location.

Figure 5:
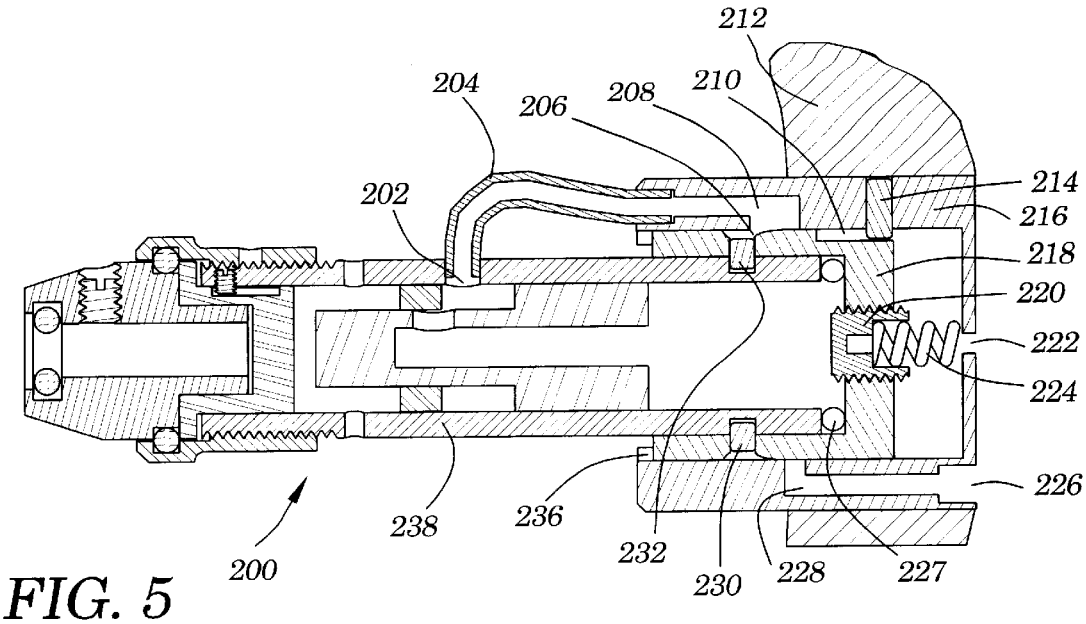
FIG. 5 is a sectional view of a second embodiment of a hand-held, pneumatic impact tool constructed in accordance with the present invention.
Figure 6:
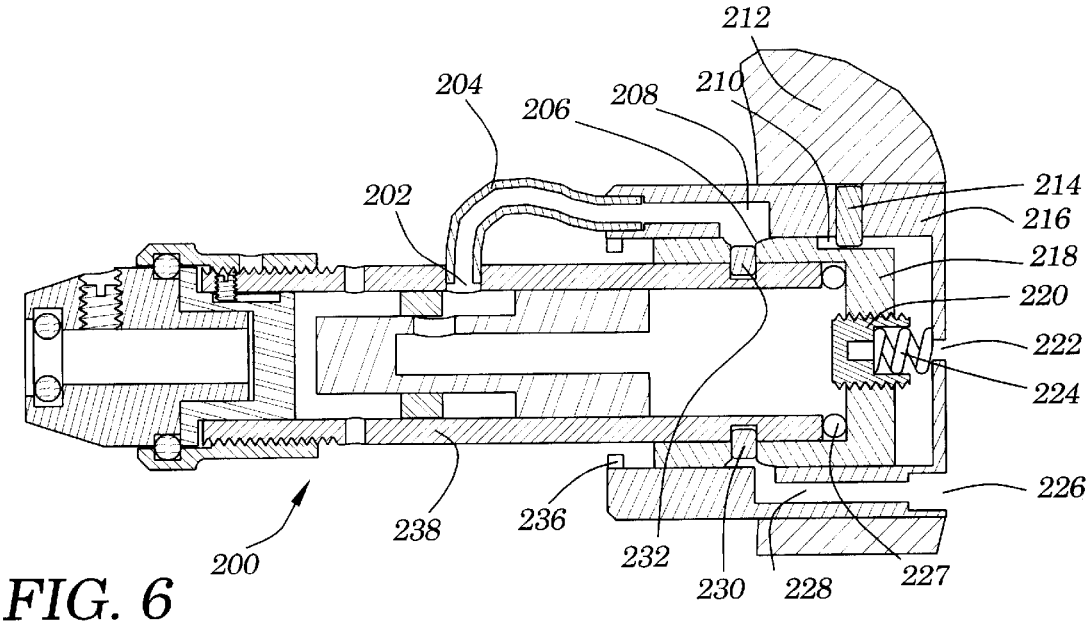
FIG. 6 is the same view as FIG. 5, differing in that the device is depicted as it would be when the handle of the tool is being pushed by the palm of a human hand.

Detailed Description (Second Embodiment FIG. 5 and FIG. 6)

It should be noted that the second, third, fourth and fifth embodiments of the hand pressure activated tool utilize a prior art nose or front end illustrated on the tool. The nose in this configuration is used for adjusting the piston length impact stroke. The length of impact stroke adjustment illustrated is disclosed in utility patent application Ser. No. 09/876,434 in the name of Steven Lindsay. Therefore, the length of stroke adjustment in the nose of the tool will not be detailed in the description of the present invention. The attachment means of the body of the tool to the handle assembly in embodiments two through five of the present invention is also prior art and is described in the second embodiment of the present invention. Prior application Ser. No. 09/754,889 in the name of Steven Lindsay should be referred to for a additional disclosure of this handle attachment means.

As in the first embodiment, the general operation and use of the hand pressure activated tool in the second through the fifth embodiments are the same although the adjustable valve and porting is constructed in the handle end of the tool rather than the body as it is in the first embodiment.

FIG. 5 and FIG. 6 illustrate a second embodiment of a variable, hand pressure activated power tool constructed in accordance with the present invention. Referring to FIG. 5 a second hand-held pneumatic impact handpiece 200 in accordance with the present invention includes a body 238 that attaches to end cap 218 with an airtight seal. The attachment means illustrated is from utility patent application Ser. No. 09/754,889 in the name of Steven Lindsay. The attachment means utilizes pins 230 and 232 that are fixed to end cap 218 with a portion of the pins protruding through the inside diameter of end cap 218. There are two slots running from the handle end of body 238 on the outside diameter of body 238 that pins 230 and 232 mate with. The slots run a distance onto the diameter of body 238 and then change to an axial rotational direction for a distance creating two "L" shaped slots that are 180 degrees apart from each other on the diameter of body 238. End cap 218 is placed onto body 238 by pushing and then turning. O-ring 227 is compressed between the two mating parts creating an airtight seal. Please refer to prior application Ser. No. 09/754,889 in the name of Steven Lindsay for more information regarding this attachment means. End cap 218 also includes a gentle slope groove 206 running around the outside diameter of the part. Pins 230 and 232 are placed in the bottom of gentle slop groove 206 for convenience allowing them to be out of the way of the outside diameter of end cap 218. End cap 218 also includes an index slot 210 running a linear direction that is wide enough for a sliding fit to index pin 214. End cap 218 also includes a threaded hole for mating to a spring tension screw 220. Handpiece 200 also includes a handle slide 216 with an outside diameter and a recess with an inside diameter. The inside diameter of handle slide 216 and the outside diameter of end cap 216 are fit with an airtight sliding fit. It is not illustrated in the drawing, but rubber O-rings may be utilized to aid in this airtight sliding fit. Handle slide 216 includes an air inlet 226, an inlet passageway 228, an outlet passageway 208, a spring tension access hole 222 and a slide stop ring 236 that is fixed in the position illustrated to handle slide 216. Index pin 214 is also fixed in the position illustrated to handle slide 216. Body 238 also includes a handpiece inlet port 202 that is connected and in communication with flexible tubing 204 to outlet passageway 208. Second handpiece 200 also includes a spring 224 and a handle 212 that is shaped to comfortably fit the palm of the human hand that is fixed in the position illustrated onto handle slide 216.

Operation (Second Embodiment FIG. 5 and FIG. 6)

Referring to FIG. 5, with a supply of regulated pressurized air in communication with air inlet 226 and passageway 228 and with handle slide 216 in the position illustrated in FIG. 5 in relation with end cap 218 the power tool is in the off position. Referring to FIG. 6, when a user holds the tool in his or her palm with a tool tip installed in the tool and the tool tip is pressed lightly against a work surface, spring 224 will begin to depress allowing handle slide 216 to move in relation to end cap 218. Passageway 228 will begin to come in communication with gentle slope groove 206 on the outside diameter of end cap 218. Air flow will begin to flow through gentle slope groove 206, to outlet passageway 208, to flexible tubing 204, to handpiece inlet port 202 and thus begin to oscillate the piston. As the user continues to press harder on the handle of the power tool, greater air flow and pressure is permitted to flow through the device for operating the power impact tool delivering harder and harder impacts. When the user finishes the impacting task and relieves pressure from the handle by removing the tool tip point from the work, the tool will return to the off position illustrated in FIG. 5. Spring tension access hole 222 can be adjusted by the user. He or she reaches in through tension access hole 222 with a hex wrench or screw driver and adjusts spring tension screw 220. In this way, the strength at which the tool requires to receive sufficient hand pressure to begin to depress spring 224 for allowing the impact tool's piston to begin osculating can be adjusted. The user's preferences and the work at hand will determine the tension and strength of the spring desired.

Figure 7:
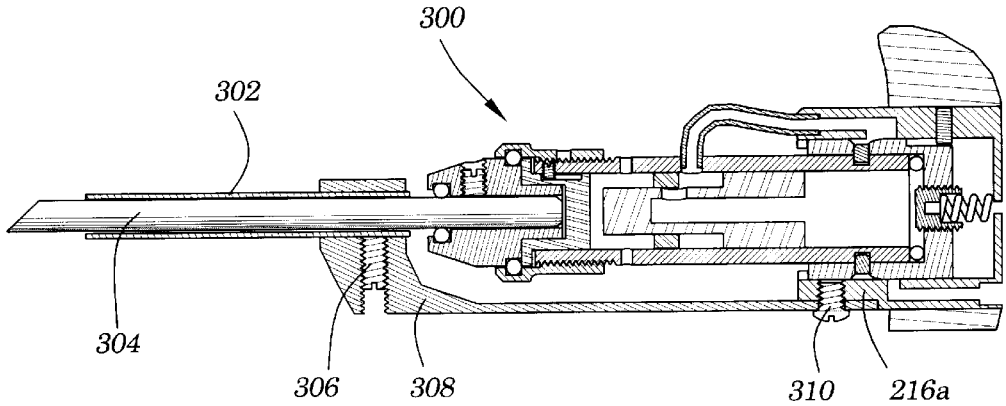
FIG. 7 is a sectional view of a third embodiment in accordance with the present invention differing from the second embodiment illustrated in FIG. 5 and FIG. 6 by an addition of a bracket assembly used to keep the user's hand or fingers from being in contact with the tool tip.

Detailed Description (Third Embodiment FIG. 7)

FIG. 7 illustrates a third embodiment of a variable, hand pressure activated power tool constructed in accordance with the present invention. Referring to FIG. 7, a third hand-held pneumatic impact handpiece 300 in accordance with the present invention includes all of the same elements disclosed in the second embodiment with the addition of a bracket assembly. A tool tip 302 is illustrated installed in the nose of the tool for describing the use of the bracket assembly in this embodiment. Handle slide 216*a* includes a flat section cut out of the bottom portion of its diameter to accommodate bracket 308. Bracket screw 310 is used to fasten bracket 308 rigidly to handle slide 216*a*. Rigid tubing 302 has an inside diameter large enough for tool tip 304 to freely slide within it. The outside diameter of ridged tubing 302 is the same as the diameter of an accommodating hole in the front end of bracket 308. Setscrew 306 is used to fasten rigid tubing 302 securely to bracket 308 within the accommodating hole in the front end of bracket 308.

Operation (Third Embodiment FIG. 7)

The pneumatic operation of the tool in the third variable, hand pressure activated power tool 300 embodiment is the same as that disclosed in the second embodiment with the addition of the rigid tube 302 being rigidly attached to handle slide 312 via bracket 308. The bracket assembly is installed to prevent the user's fingers from being in contact with tool tip 308 or the body of the tool during operation. When a user operates the tool, the handle portion of the tool sets in the lower portion of the palm of the hand and the thumb and index finger grip the tool tip close to the tip itself. The middle and ring fingers wrap around the tool riding on the bottom of the body of the tool. The pinky finger wraps around and rides on the bottom flat of the handle. With the bracket assembly in place as illustrated in FIG. 7, hand and finger contact with the body and tool tip during operation is eliminated. With the palm push throttle in the handle of the tool and without the disclosed bracket installed the fingers can interfere with a total palm pressure activation of the tool. The applicant has been a full time hand engraver for 23 years and after using the device he has found that he likes the tool better without the bracket in place When an engraver or jeweler is gripping the tool without a bracket and he or she wants to go deeper when engraving, he or she not only will naturally push slightly harder to hold the tool tip in the cut but will also grip the tool more tightly. When gripping or squeezing the thumb and index fingers together on the tool tip, the fingers naturally also contract and will pull the graver tool tip in towards the palm of the hand, thereby activating the power tool. The applicant has learned to take advantage of this and uses a combination of palm push pressure together with squeeze pressure for controlling the variable, hand activated power tool. The bracket as disclosed in this third embodiment in FIG. 7 will be a great benefit for those learning to engrave or for engravers who have not used a power graver before and are comfortable with the traditional palm push method. With the bracket assembly in place the tool is truly the same technique as the non power palm push method simulating having a great amount of hand and art strength in that the user only exerts enough pressure to activate the impact power to the desired level. For fine work, the bracket assembly can be used installed on the power tool or removed, again depending on the personal preferences of the hand engraver or jeweler.

The bracket assembly in this third embodiment in FIG. 7 can be employed with all of the disclosed embodiments and equivalence thereof in accordance with the present invention.

Figure 8:
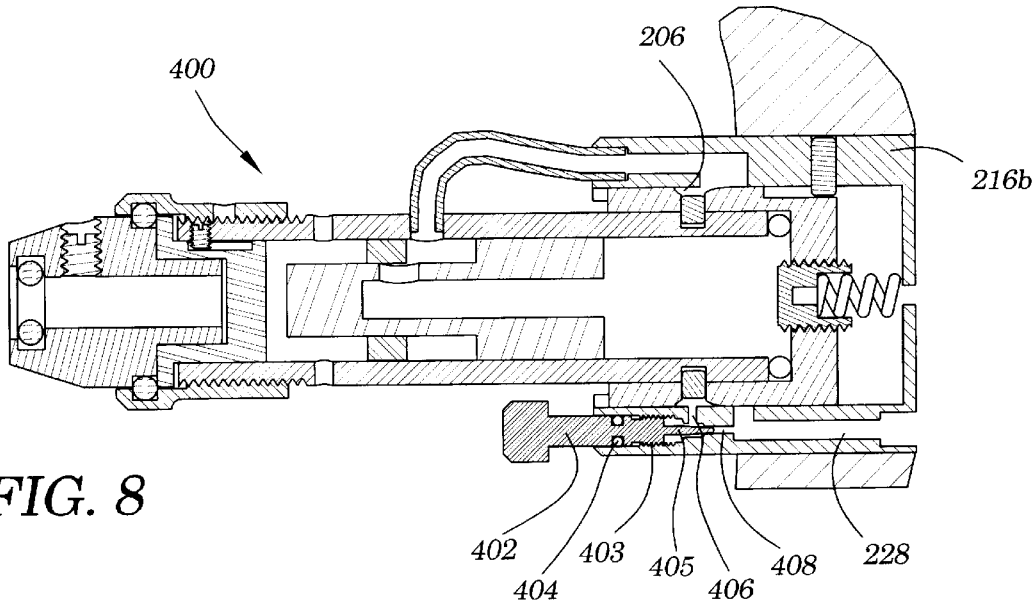
FIG. 8 is a sectional view of a fourth embodiment in accordance with the present invention differing from the second embodiment illustrated in FIG. 5 and FIG. 6 by a needle valve adjustment for the user to adjust, permitting a small amount of pressurized air to be bled to the handpiece to oscillate the piston in a continuous idling ready state.

Detailed Description (Fourth Embodiment FIG. 8)

FIG. 8 illustrates a fourth embodiment of a variable, hand pressure activated power tool constructed in accordance with the present invention. Referring to FIG. 8, a fourth hand-held pneumatic impact handpiece 400 in accordance with the present invention differs only from the second embodiment illustrated in FIG. 5 and FIG. 6 by having the addition of a needle valve adjustment feature to permit a small amount of pressurized air to oscillate the piston in a continuous, idling ready state. The idling state of the tool is desirable for the same reasons described in the first embodiment of the invention. Referring to FIG. 8, the fourth hand-held pneumatic impact handpiece 400 includes a handle slide 216*b* with a mating, partially threaded hole 403 accommodating needle screw 402. Needle screw 402 includes a tapered needle 405 that mates to a small needle hole 408. O-ring 404 is included on needle screw 402 to permit an airtight fit between needle screw 402 and the mating, partially threaded hole 403 in handle slide 216*b*.

Operation (Fourth Embodiment FIG. 8)

When the user of the impact tool is not pressing on the handle for operation of impacts, it is desirable to have the piston idling in a ready state with the piston oscillation but not impacting. Needle screw 402 is used by the operator by adjusting the needle screw so that tapered needle 405 is not quite seated in small needle hole 408. This will permit a small amount of air pressure to flow from inlet passageway 228 that is in communication with the source of pressurized air to small needle hole 408, through inlet 406, through gentle slope groove 206 and continue on to the body of the tool for causing the piston to oscillate. Once this piston idling adjustment is set by the user it will not need to be adjusted during normal operation.

Figure 9:
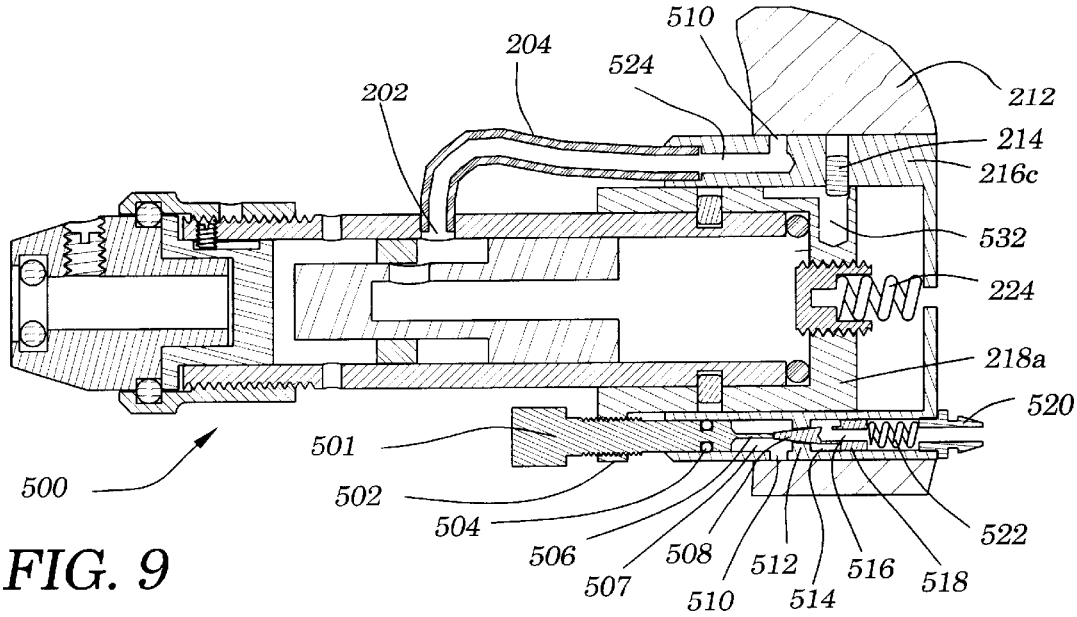
FIG. 9 is a sectional view of a fifth and preferred hand-held pneumatic impact tool embodiment constructed in accordance with the present invention.
Figure 10:
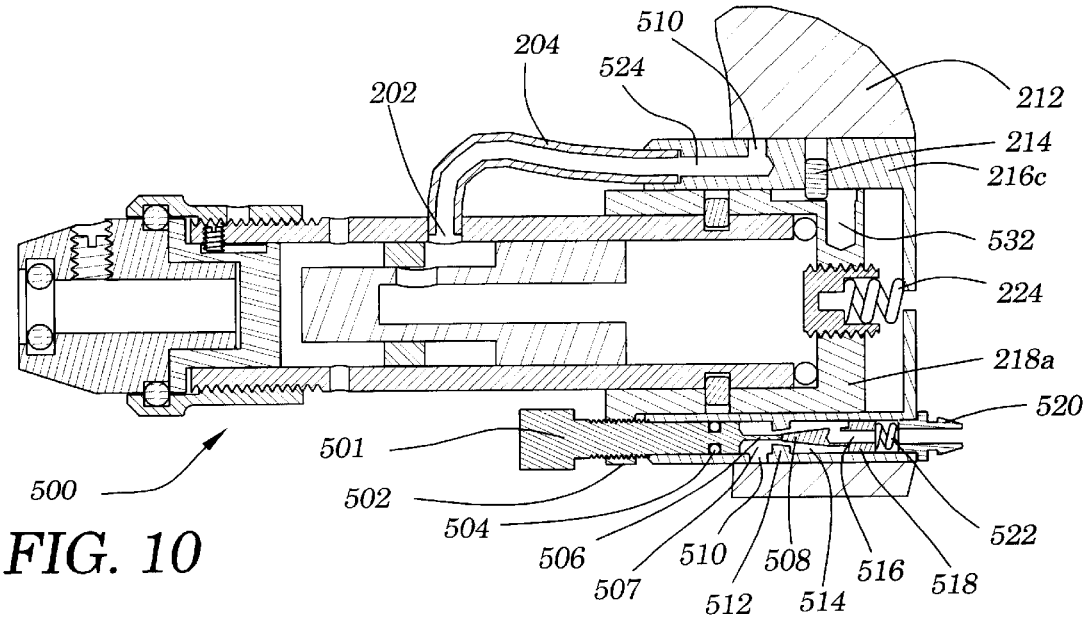
FIG. 10 is the same view as FIG. 9, differing in that the device is depicted as it would be when the handle of the tool is being pushed by the palm of a human hand.

Detailed Description (Fifth and Preferred Embodiment FIG. 9 and FIG. 10)

FIG. 9 and FIG. 10 are two sectional views of a fifth and preferred variable hand pressure activated power tool constructed in accordance with the present invention. Referring to FIG. 9, the fifth hand-held, pneumatic impact handpiece 500 includes an end cap 218*a* with a raised lip 502 containing a threaded hole 503 for mating external threads of a needle pusher 501. Impact handpiece 500 also includes handle slide 216*c* with an inside diameter for permitting a sliding fit with the outside diameter of end cap 218*a*. Index pin 214 is fixed in the position illustrated to handle slide 216*c*. End cap 218*a* includes an index slot 528 running a linear direction which is wide enough to permit a sliding fit to the diameter of index pin 530. Index slot 528 does not run all the way to the end of the part but stops short to allow index pin 214 to prevent handle slide 216*c* from sliding all the off of end cap 218*a*. To assist taking the device apart after it is assembled, oversized hole 532 is included at the end of index slot 528 for providing a void for index pin 214 to be driven out of its ridged position in handle slide 216*c*. Handle slide 216*c* includes a pusher hole 507 for accommodating a sliding fit to needle pusher 501 that includes sealing o-ring 504. Handle slide 216*c* also includes an inlet hole 521 for accommodating a fixed in position hose barb 520, a ported needle 518 with a tapered needle 508 and a chamber 514. A needle spring 522 is included between hose barb 520 and ported needle 518 for providing biasing tension for seating tapered needle 508 against tapered port hole 512 and thereby sealing the air passageway between inlet hole 521 and pusher hole 507. Handle slide 216*c* also includes an annular slot 510 cut 360 degrees around its diameter. Annular slot 510 is made deep enough to intersect pusher hole 507 and an outlet passageway 524. Outlet passageway 524 is in communication with handpiece inlet port 202 via flexible tubing 204. Handle 212 has a rigid and airtight fit onto the outside diameter of handle slide 216*c*.

Operation (Fifth and Preferred Embodiment FIG. 9 and FIG. 10)

Referring to FIG. 9, a supply of regulated pressured air is introduced to handpiece 500 via tubing (not shown) to hose barb 520. The pressurized air will travel through hose barb 520, through and around spring 522, through ported needle 518 via needle passage 516 to chamber 514 and go no further. When the user of the impact handpiece 500 begins to depress the handle of the device in the palm of his hand spring 224 will depress allowing handle 212 and handle slide 216*c* to slide over end cap 218*a*. Because needle pusher 501 is attached to end cap 218*a* with threads through raised lip 502, needle pusher 501 will remain in position with end cap 218*a* while handle slide moves axially. This axial movement will cause pusher point 506 to press against tapered needle 508 causing ported needle 518 to depress spring 522. FIG. 10 illustrates the result of this movement. Referring to FIG. 10, the movement unseats tapered needle 508 from its seated position against tapered port hole 512, thereby opening communication for pressurized air to flow through tapered port hole 512 into pusher hole 507, to annular slot 510, to outlet passageway 524, through flexible tubing 204 leading to handpiece inlet port 202 and finally to the piston in the handpiece for impact operation of the tool. As the user continues to increase pressure on the handle of the device with the palm of his hand, ported needle 518 will continue to move creating a larger opening between tapered needle 508 and tapered port hole 512 permitting increased air flow through tapered port hole 512 thereby increasing the impacting power of the tool. When the user finishes the impact operation he releases pressure on the handle in his hand and the biasing tension from spring 224 will return the handle of the device to its original position illustrated in FIG. 9 with index pin 214 at the end or stop of index slot 528. Needle pusher 501 includes external threads for mating with threaded hole 503 thereby providing adjustability with needle pusher 501. Needle pusher is used for setting and adjusting the piston's oscillation idle (oscillation without impacting). When the user adjusts needle pusher 501 to cause tapered needle 508 to not quite seat in tapered port hole 512 a small amount of pressurized air is allowed to flow to the piston while the handle of the tool is not depressed by the user thereby permitting the piston to oscillate in the idling ready-state as described in the first embodiment of the disclosed invention.

Conclusion, Ramifications, and Scope

Accordingly, the reader will see that the variable, pressure activated pneumatic impact power tool provides a great benefit for helping the jeweler or engraver carry out work more easily and quickly. The invention has advantages in that it provides a palm push, hand engraving power tool that is activated from an absence of power to much greater power or anywhere in between simply by the amount of pressure exerted by the palm of a human hand on the tool's handle. Prior Art hand engraving power tools use a foot control to control the impact power of the tools. People who are highly skilled at palm push methods of hand engraving as well as people learning to hand engrave, have a challenge to learn to coordinate the foot control and hand when desiring to make an engraving cut with the prior art hand engraving tools. Because of this, damage can occur to the work and the tool tip if the user depresses the foot control on prior art power gravers without the tool's point being held in the work. When using these prior art devices, it is imperative to keep the tool tip held snugly in the cut while the foot control is depressed to prevent damage to the tool tip or damage to the item being engraved. Because the present invention eliminates the foot control, it makes using a hand engraving power tool more natural and permits users to learn to hand engrave more quickly. Because the present invention will only operate while held in the work it prevents the problems spoken of with a foot controlled hand engraving power device.

Additional Benefit

Because the pressure activation and valving for the second, third, fourth and fifth embodiment of the present invention is totally contained in the handle of the tool, the palm push apparatus in the handle can easily be removed and substituted for other handles with push and turn removable handles. In this configuration users may switch easily between a plain handle and use the handpiece of prior art with a foot control throttle or they may use the handpiece with the present invention of the palm push activated handle throttle.

Although the invention has been described with reference to five illustrated embodiments, it is noted that equivalents may be employed and substitutions made herein without departing from the scope of the invention as recited in the claims. For example:

In embodiment one, FIG. 3 and FIG. 4, a less complex device using the same principle can be constructed by combining swivel ring 62, idle adjust ring 70, and sliding sleeve 84 into one piece;

More than one of each of any of the following could be included in embodiment one: inlet port 96, intake hole 68, slot 74, and pin 72 over the number of those illustrated;

The bracket assembly disclosed in embodiment three, FIG. 7 can be utilized on any of the four other embodiments disclosed.

The incoming air supply to the handpiece handle and the out going air connection leading to the body of the handpiece in embodiments two, three, four, and five are illustrated in the drawings 180 degrees from each other, however this is not necessary and may be placed in any index position. The drawings only disclosed the invention with them 180 degrees apart for simplifying the drawings and to help make the disclosure more easily read, viewed and understood by the reader.

The specifications describe the use of pressurized air for powering the illustrated embodiments, however, the scope of the invention is not limited to pressurized air. Any pressurized fluid may be employed for powering the disclosed embodiments. In addition, the scope of the invention is wider, including any power source for supplying power to a hand held engraving power tool in the hand engraving and jewelry fields without departing from the present invention. Equivalents of the present invention can be utilized using various power sources for powering a hand-held engraving power tool, including, but not limited to, electric, pneumatic, ultrasonic or other sources of power for operating a hand-held engraving tool.

Although the five embodiments disclosed depict the present invention in a hand powered graver used in the hand engraving and jewelry fields, the scope of the invention is not limited to this field of use. Equivalents of the device can be employed for use in other fields that can benefit from a fluid powered hand pressure activated hand power tool. Any fluid powered hand power tools that naturally use a small amount of hand force to hold a tool tip against the work surface can benefit from the present invention.

Accordingly, the scope of the invention should be determined not by the embodiments illustrated, but by the appended claims and their legal equivalents.

I claim:

1. A hand-held power tool for use in hand working operations, for use with a supply of pressurized fluid, comprising:

a body having a first and a second end;

a tool tip holder at said first end for holding a tool tip;

a hand placement location on said hand-held power tool for the user of said hand-held power tool to grip and hold said hand-held power tool during operation;

a work energy means for supplying work energy to said tool tip;

a variable fluid metering means for adjusting the amounts of said supply of pressurized fluid used for supplying varying amounts of said work energy means to said tool tip;

a pressure sensing means for sensing the amount of pressure exerted by a human hand;

between said hand placement location and said tool tip;

said variable fluid metering and said work energy means will increase when pressure sensing means senses increased pressure; and said variable fluid metering and said work energy means will decrease when pressure sensing means senses decreased pressure.

2. A hand-held power tool as recited in claim 1, further comprising;

a handle located on said second end; and said pressure sensing means is located within said handle.

3. A hand-held power tool as recited in claim 1, wherein said pressure sensing means is located within said body.

4. A hand-held power tool as recited in claim 1, further comprising;

a handle at said second end;

said body containing a bore;

said bore having a longitudinal axis; and a piston received within said bore and being shiftable relative to said body along said longitudinal axis.

5. A hand-held power tool as recited in claim 4, further comprising;

an oscillation means by which said piston will oscillate under the action of said pressurized fluid;

said work energy means in the form of impacts in which said piston will collide into said tool tip holder within said body;

said adjustable fluid flow means includes an inlet port in communication with said supply of pressurized fluid; and said variable fluid metering is movable between an off position in which the fluid flow is zero and a number of on positions in which the fluid flow ranges from zero to the pressure of said supply of pressurized fluid.

6. A hand-held power tool for use in hand working operations in the hand engraving and jewelry fields, comprising:

a body having first and second ends;

a tool tip holder located at said first end for holding a tool tip;

a handle made to be held in the human hand on said body;

a variable power means for delivering variable power to said tool tip;

a pressure sensing means for sensing the amount of pressure exerted by a human hand;

between said handle and said tool tip;

said variable power means will increase in power when said pressure sensing means senses increased pressure exerted by the user of said hand-held power tool on said handle with the human hand; and said variable power means will decrease in power when said pressure sensing means senses decreased pressure exerted by the user of said hand-held power tool on said handle with the human hand.

7. A hand-held power tool as recited in claim 6, wherein said pressure sensing means is located within said handle.

8. A hand-held power tool as recited in claim 6, wherein said pressure sensing means is located within said body.

9. A hand-held power tool as recited in claim 6, further comprising;

said body containing a bore;

said bore having a longitudinal axis; and a piston received within said bore and being shiftable relative to the body along said longitudinal axis.

10. A hand-held power tool as recited in claim 9, further comprising;

said variable power means is in the form of pressurized fluid;

an oscillation means by which said piston will oscillate under the action of said pressurized fluid;

an adjustable fluid flow means including an inlet port in communication with supply of pressurized fluid; and said adjustable fluid flow means is movable between an off position in which the fluid flow is zero and a number of on positions in which the fluid flow ranges from zero to the pressure of said pressurized fluid.

11. A hand-held pneumatic impact power tool for use in hand working operations for use with a supply of pressurized fluid, comprising:

a body containing a bore and having first and second ends;

said bore having a central longitudinal axis;

a piston received within said bore and being shiftable relative to the body along said longitudinal axis;

a tool tip holder at said first end for holding a tool tip;

an oscillation means by which said piston will oscillate under the action of said supply of pressurized fluid;

a flow control element;

an inlet port;

said inlet port in communication with said supply of pressurized fluid;

said flow control element is movable between an off position in which the fluid flow is zero and a number of on positions in which the fluid flow ranges from zero to the pressure of said supply of pressurized fluid; and a pressure sensing element for sensing the amount of pressure exerted by a human hand; between said second end and said tool tip.

12. A hand-held pneumatic impact power tool as recited in claim 11, wherein said pressure sensing element is located within said handle.

13. A hand-held pneumatic impact power tool as recited in claim 11, wherein said pressure sensing element is located within said body.

* * * * *

UNITED STATES PATENT AND TRADEMARK OFFICE

CERTIFICATE OF CORRECTION

PATENT NO. : 6,691,798 B1
DATED : February 17, 2004
INVENTOR(S) : Steven J. Lindsay It is certified that error appears in the above-identified patent and that said Letters Patent is hereby corrected as shown below:

Column 10,
Line 51, after "exerted by a human hand" delete the punctuation mark ";".
Line 52, adjust the formatting so the beginning of this line is at the end of the line before it.

Column 11,
Line 32, after "exerted by a human hand" delete the punctuation mark ";".
Line 33, adjust the formatting so the beginning of this line is at the end of the line before it.

Column 12,
Line 36, after "exerted by a human hand" delete the punctuation mark ";".

Signed and Sealed this

Twenty-seventh Day of April, 2004

JON W. DUDAS
*Acting Director of the United States Patent and Trademark Office*